US006778808B1

(12) United States Patent
Shimazu

(10) Patent No.: US 6,778,808 B1
(45) Date of Patent: Aug. 17, 2004

(54) ROUTE-ADAPTIVE ON-DEMAND RADIO COMMUNICATION SYSTEM FOR A DRIVER, COMMUNICATION METHOD USING THE SAME, AND RECORDING MEDIUM STORING A PROGRAM FOR EXECUTING THE METHOD

(75) Inventor: Hideo Shimazu, Tokyo (JP)

(73) Assignee: NEC Corporation, Tokyo (JP)

( * ) Notice: Subject to any disclaimer, the term of this patent is extended or adjusted under 35 U.S.C. 154(b) by 546 days.

(21) Appl. No.: 09/695,319

(22) Filed: Oct. 25, 2000

(30) Foreign Application Priority Data

Oct. 26, 1999 (JP) ..... 11-304384

(51) Int. Cl.[7] ..... H04H 1/00

(52) U.S. Cl. ..... 455/3.03; 455/186.1; 455/3.06

(58) Field of Search ..... 455/186.1, 3.02, 455/12.1, 3.03, 88, 457, 456, 3.01, 3.06, 345, 221, 158, 142; 701/207, 35, 201, 209, 213, 211, 204, 206, 200; 707/104.1, 3, 209, 100; 340/995, 990, 988, 438; 342/451; 348/467

(56) References Cited

U.S. PATENT DOCUMENTS

| | | | | | |
|---|---|---|---|---|---|
| 4,476,582 | A | * | 10/1984 | Strauss et al. | 455/166 |
| 5,276,909 | A | * | 1/1994 | Milner et al. | 340/7.49 |
| 5,303,393 | A | * | 4/1994 | Noreen et al. | 455/3.2 |
| 5,732,324 | A | * | 3/1998 | Rieger, III | 455/3.1 |
| 5,897,602 | A | * | 4/1999 | Mizuta | 701/201 |
| 6,101,443 | A | * | 8/2000 | Kato et al. | 701/210 |
| 6,438,561 | B1 | * | 8/2002 | Israni et al. | 707/104.1 |
| 2001/0014841 | A1 | * | 8/2001 | Shimazu | 701/1 |

FOREIGN PATENT DOCUMENTS

| | | |
|---|---|---|
| JP | 05-081597 | 4/1993 |
| JP | 06-104856 | 4/1994 |
| JP | 08-022595 | 1/1996 |
| JP | 08-110755 | 4/1996 |
| JP | 8-191255 | 7/1996 |
| JP | 08-339490 | 12/1996 |
| JP | 09-55673 | 2/1997 |
| JP | 09-271010 | 10/1997 |
| JP | 09-280874 | 10/1997 |
| JP | 09-292247 | 11/1997 |
| JP | 10-078901 | 3/1998 |
| JP | 10-160491 | 6/1998 |
| JP | 10-239085 | 9/1998 |
| JP | 11-041584 | 2/1999 |
| JP | 11-065434 | 3/1999 |
| JP | 11-103450 | 4/1999 |
| JP | 11-272983 | 10/1999 |
| JP | 11-304501 | 11/1999 |
| JP | 2000-502795 | 3/2000 |
| JP | 2001-086014 | 3/2001 |
| JP | 2001-119358 | 4/2001 |

OTHER PUBLICATIONS

Japanese Office Action dated Jun. 17, 2003 with partial English translation.

* cited by examiner

*Primary Examiner*—Quochien B. Vuong
*Assistant Examiner*—C. Chow
(74) *Attorney, Agent, or Firm*—McGinn & Gibb, PLLC

(57) ABSTRACT

In a route-adaptive on-demand radio communication system, a program selector (15) selects, from a plurality of broadcast programs broadcasted from a broadcasting apparatus (11), a matched one of the broadcast programs that matches the type information stored in a favorite storage unit (13) and the location information of one of a start point, transit points, and a destination point stored in a route storage unit (14). The matched broadcast program is stored in a broadcast program storage unit (16). A reproduction program selector (20) selects, as a selected broadcast program, the matched broadcast program stored in the broadcast program storage device if the matched broadcast program matches a current time instant held in a current time instant storage unit (17) and a current location held in a current location storage unit (18). The selected broadcast program is reproduced by a reproducing unit (19).

19 Claims, 8 Drawing Sheets

ROUTE-ADAPTIVE ON-DEMAND RADIO COMMUNICATION SYSTEM FOR A DRIVER, COMMUNICATION METHOD USING THE SAME, AND RECORDING MEDIUM STORING A PROGRAM FOR EXECUTING THE METHOD

BACKGROUND OF THE INVENTION

This invention relates to a route-adaptive on-demand radio communication system for a driver, a communication method using the system, and a recording medium storing a program for executing the method and, in particular, to a route-adaptive on-demand radio communication system preliminarily supplied with a scheduled route for selectively receiving and reproducing a broadcast program adapted to time information and location information at each transit point a communication method using the system, and a recording medium storing a program for executing the method.

In recent years, a car navigation system for use in an automobile becomes increasingly used. An improved car navigation system has a communication function. Specifically, the improved car navigation system acquires various kinds of information, for example, about restaurants or play spots through a portable cellular telephone or a mobile cellular telephone. The information on stores or shops is also available as software in a CD (Compact Disk) or a DVD (Digital Video Disk). However, such information is changeable and the change may be very frequent. Under the circumstances, the car navigation system having a communication function is advantageous in that latest information can be acquired through communication.

For the car navigation system having a communication function, information services specialized in providing information for a driver of the automobile as a user are known. The above-mentioned services assume bi-directional communication between a service provider and the driver.

Apart from the above, "Vehicle Information and Communication System" Information Service is also known. In the "Vehicle Information and Communication System", it is possible to acquire traffic information such as traffic jam and traffic control or parking information indicative of the availability of a parking space in a parking lot and to display the information on a navigator screen. The "Vehicle Information and Communication System" utilizes two types of beacon signals, namely, light and radio waves transmitted from beacon sources arranged along a highway, and a wide-band FM (Frequency Modulation) radio wave. The above-mentioned service is presented via a one-way or unidirectional communication from the service-provider to the driver.

In the world of the Internet, a so-called PUSH technique is popularly used. For example, PointCast (see: www.pointcast.com) provided a service called "PointCast Network". The mechanism of the "PointCast Network" is as follows. The user or the driver preliminarily registers in his PC (Personal Computer) the types of desired information he requires. Then, the user's PC automatically accesses via the Internet to a WWW server of the "PointCast Network" at predetermined cycles (for example, once an hour or once a day) to acquire the latest information on the WWW server and to display the information on the user's PC. Thus, an uncontrolled, continuous, and nonstop effluence of related information corresponding to the desired information he selected is automatically supplied to the user for his review and observation.

Japanese Unexamined Patent Publication (JP-A) No. H08-191255 discloses a technique relating to a FM multiplex broadcasting receiver for receiving multiplex broadcasting and selecting desired information relating to a local area included in a route between a current location and a destination point to supply the desired information to a navigator. Specifically, the navigator preliminarily supplies the FM multiplex broadcasting receiver with an area code indicative of the local area included in the route from the current location of an automobile to the destination point. Then, from a plurality of area information extracted from the multiplex broadcasting through an antenna, a FM reception circuit, a filter, a demodulation circuit, and an error correction circuit, the microcomputer selectively extracts the desired information relevant to the area code specified by the navigator and supplies the desired information through a communication interface to the navigator.

The technique disclosed in the above-mentioned Japanese Unexamined Patent Publication (JP-A) No. H08-191255 has a problem that location information corresponding to the current location of the automobile can not be obtained with high accuracy.

In the above-mentioned technique, an adaptive program is selected by comparing location information included in the content of each broadcast program with location information related to the route preliminarily stored in a memory. With this structure, a different program which is not adapted to the current location of the automobile may possibly be selected.

In order to realize an ideal service mode for many drivers, it is required to provide selected information matching the situation or the desire of each individual user. Since most of the users are drivers, a user interface should be as simple as possible. If possible, it is convenient to provide the information as an uncontrolled, continuous, and nonstop effluence without requiring any user's operation.

The above-mentioned user interface is a one-way interface such as radio broadcasting. With such user interface, a series of information required for the driver at the current location, at the current time instant, and in the current situation is selected and automatically announced or displayed in the manner similar to the radio broadcasting. For example, the driver is given the information "McDonald is nearby", "Firework festival will start in an hour in this city", "If you go out through the second exit, you will find a gas station", "Around the noon, you will pass XX where a two-star French restaurant is available". In this event, the driver is not required to operate the navigator at all.

At present, the above-mentioned information service adaptable to every individual user is not available as far as the car navigation system is concerned. Even if such information service is provided, the bidirectional communication function is required. Disadvantageously, this results in an increase in cost on the side of the user.

In order to realize the above-mentioned information service adaptable to every individual user, the user should register the types of the information he requires while the service provider should provide the user exclusively with the information requested by the user. If only the information required for the user is presented, the user need not to tell his desire in an on-demand fashion. As a result, the user interface is simplified.

The above-mentioned "PointCast" is a technique intended to satisfy such requirements. At a first glance, the "PointCast" seems like television broadcasting. However, the television broadcasting is addressed to unspecified recipients or audiences while the "PointCast" exclusively presents particular information of the type selected by each individual user. In other words, the "PointCast" is broadcasting customized for each individual user. However, the "PointCast" is operated by the use of the communication and the user's PC must access the WWW server. If the service is used in the automobile through the portable cellular telephone, charges for the portable cellular telephone are inevitably required.

SUMMARY OF THE INVENTION

It is an object of the present invention to realize a PUSH-type information providing mechanism which is adapted for a driver moving from time to time and from place to place with a desired content variable and which does not use a communication infrastructure but uses a broadcasting infrastructure such as digital satellite radio broadcasting or digital surface wave radio broadcasting simultaneously broadcasted for unspecified recipients.

It is a specific object to provide an information providing method in which an itinerary or a route is preliminarily given and a broadcast program adapted to time information and location information at each scheduled transit point is selectively received to provide desired information such as "Go out through 'the next highway exit' and you will find XX, a favorite restaurant", "Only one gas station can be found before arriving "XXX as a next place of visit", "Favorite museum will be found 'on the way you will pass within one hour's drive from now'", and so on.

According to a first aspect of the present invention, there is provided a route-adaptive on-demand radio communication system which is for a user of a vehicle and which is for providing, by making use of one of digital satellite radio broadcasting and digital surface wave radio broadcasting simultaneously broadcasted to unspecified recipients, the user with particular information matching a current time instant and a current location of the vehicle and matching desired information preliminarily registered by the user, the system comprising:

a digital broadcasting apparatus (11) in a broadcasting station, which apparatus is for periodically broadcasting a plurality of broadcast programs by making use of the one of the digital satellite radio broadcasting and the digital surface wave radio broadcasting, each of the broadcast programs comprising a program content, a type information representative of a content type of the program content, and time information representative of a time zone during which the program content is valid, and location information representative of a location where the program content is valid;

a favorite storage unit (13) for storing a desired type of information requested by the user;

a route storage unit (14) in which pass points in a route, locations of the pass points, and a time interval required between every adjacent ones of the pass points are stored by the user;

a program selector (15) for receiving each of the broadcast programs, for comparing the type information of each of the broadcast programs with the desired type stored in the favorite storage unit, for comparing the location information of each of the broadcast programs with the location of each of the pass points stored in the route storage unit, and for selecting a matched one of the broadcast programs that has the type information coincident with the desired type of the favorite storage unit and the location information coincident with the location of each of the pass points of the route storage unit;

a broadcast program storage unit (16) for storing the matched one of the broadcast programs as a stored broadcast program;

a current time instant storage unit (17) for holding a latest value of a current time instant;

a current location storage unit (18) for holding a latest value of current location information;

a reproduction program selector (20) for periodically comparing the time information and the location information of the stored broadcast program of the broadcast program storage unit with the latest values held in the current time instant storage unit and the current location storage unit, respectively, and for selecting the stored broadcast program as a selected broadcast program when the stored broadcast program has the time information and the location information coincident with the latest values held in the current time instant storage unit and the current location storage unit; and a reproduction unit (19) for reproducing the selected broadcast program selected by the reproduction program selector.

According to a second aspect of the present invention, there is provided a route-adaptive on-demand radio communication system which is for a user of a vehicle and which is for providing, by making use of one of digital satellite radio broadcasting and digital surface wave radio broadcasting simultaneously broadcasted to unspecified recipients, the user with particular information matching a current time instant and a current location of the vehicle and matching desired information preliminarily registered by the user, the system comprising:

a digital broadcasting apparatus (11) in a broadcasting station, which apparatus is for periodically broadcasting a plurality of broadcast programs by making use of the one of the digital satellite radio broadcasting and the digital surface wave radio broadcasting, each of the broadcast programs comprising a program content, a type information representative of a content type of the program content, and time information representative of a time zone during which the program content is valid, and location information representative of a location where the program content is valid;

a favorite storage unit (13) for storing a desired type of information requested by the user;

an expanded route storage unit (24) in which pass points in a route, locations of the pass points, and a time interval required between every adjacent ones of the pass points are stored by the user, the expanded route storage unit having an actual pass time instant storage area;

a program selector (15) for receiving each of the broadcast programs, for comparing the type information of each of the broadcast programs with the desired type stored in the favorite storage unit, for comparing the location information of each of the broadcast programs with the location of each of the pass points stored in the expanded route storage unit, and for selecting a matched one of the broadcast programs that has the type information coincident with the desired type of the favorite storage unit and the location information coincident with the location of each of the pass points of the expanded route storage unit;

a broadcast program storage unit (16) for storing the matched one of the broadcast programs as a stored broadcast program;

a current time instant storage unit (17) for holding a latest value of a current time instant;

a current location storage unit (18) for holding a latest value of current location information;

a pass information writing unit (25) for writing, into the actual pass time instant storage area of the expanded route storage unit in correspondence to each pass point stored in the expanded route storage unit, an actual pass time instant at which the vehicle actually passes each pass point stored in the expanded route storage unit;

a next time point calculator (22) for calculating, with reference to the expanded route storage unit, a scheduled arrival time instant for the arrival to a next pass point next to a latest pass point at a latest pass time instant before the latest value of the current time instant held in the current time instant storage unit;

a next point calculator (23) for calculating, with reference to the expanded route storage unit, the location of the next pass point on the basis of the latest value of the current location information held in the current location storage unit;

a next-point-adaptive reproduction program selector (21) for periodically comparing the time information and the location information of the stored broadcast program of the broadcast program storage unit with calculated result of the next time point calculator and the next point calculator, respectively, and for selecting the stored broadcast program as a selected broadcast program when the stored broadcast program has the time information and the location information coincident with the calculated result of the next time point calculator and the next point calculator; and a reproduction unit (19) for reproducing the selected broadcast program selected by the reproduction program selector.

According to a third aspect of the present invention, there is provided a route-adaptive on-demand radio communication method which is for a user of a vehicle and which is for providing, by making use of one of digital satellite radio broadcasting and digital surface wave radio broadcasting simultaneously broadcasted to unspecified recipients, the user with particular information matching a current time instant and a current location of the vehicle and matching desired information preliminarily registered by the user, the method comprising:

a first step of making a digital broadcasting apparatus (11) of a broadcasting station periodically broadcast a plurality of broadcast programs by making use of the one of the digital satellite radio broadcasting and the digital surface wave radio broadcasting, each of the broadcast programs comprising a program content, a type information representative of a content type of the program content, and time information representative of a time zone during which the program content is valid, and location information representative of a location where the program content is valid;

a second step of making a favorite storage unit (13) store a desired type of information requested by the user;

a third step of making a route storage unit (14) store pass points in a route, locations of the pass points, and a time interval required between every adjacent ones of the pass points by the user;

a fourth step of making a current time instant storage unit (17) hold a latest value of a current time instant;

a fifth step of making a current location storage unit (18) hold a latest value of current location information:

a sixth step of receiving each of the broadcast programs;

a seventh step of comparing the type information of each of the broadcast programs with the desired type of the favorite storage unit and comparing the location information of each of the broadcast programs with the location of each of the pass points of the route storage unit to select a matched one of the broadcast programs that has the type information coincident with the desired type of the favorite storage unit and the location information coincident with the location of each of the pass points of the route storage unit;

an eighth step of making a broadcast program storage unit (16) store the matched one of the broadcast programs as a stored broadcast program;

a ninth step of periodically comparing the time information and the location information of the stored broadcast program of the broadcast program storage unit with the latest values of the current time instant storage unit and the current location storage unit, respectively, to select the stored broadcast program as a selected broadcast program when the stored broadcast program has the time information and the location information coincident with the latest values held in the current time instant storage unit and the current location storage unit; and a tenth step of reproducing the selected broadcast program.

According to a fourth aspect of the present invention, there is provided a route-adaptive on-demand radio communication method which is for a user of a vehicle and which is for providing, by making use of one of digital satellite radio broadcasting and digital surface wave radio broadcasting simultaneously broadcasted to unspecified recipients, the user with particular information matching a current time instant and a current location of the vehicle and matching desired information preliminarily registered by the user, the method comprising:

a first step of making a digital broadcasting apparatus (11) of a broadcasting station periodically broadcasting a plurality of broadcast programs by making use of the one of the digital satellite radio broadcasting and the digital surface wave radio broadcasting, each of the broadcast programs comprising a program content, a type information representative of a content type of the program content, and time information representative of a time zone during which the program content is valid, and location information representative of a location where the program content is valid;

a second step of making a favorite storage unit (13) store a desired type of information requested by the user;

a third step of making an expanded route storage unit (24) store pass points in a route, locations of the pass points, and a time interval required between every adjacent ones of the pass points by the user, the expanded route storage unit having an actual pass time instant storage area;

a fourth step of making a current time instant storage unit (17) hold a latest value of a current time instant;

a fifth step of making a current location storage unit (18) hold a latest value of current location information;

a sixth step of receiving each of the broadcast programs;

a seventh step of comparing the type information of each of the broadcast programs with the desired type of the favorite storage unit and comparing the location information of each of the broadcast programs with the location of each of the pass points of the expanded route storage unit to select a matched one of the broadcast programs that has the type information coincident with the desired type of the favorite storage unit and the location information coincident with the location of each of the pass points of the expanded route storage unit;

an eighth step of making a broadcast program storage unit (16) store the matched one of the broadcast programs as a stored broadcast program;

a ninth step of comparing the latest value of the current location information of the current location storage unit with the location of each pass point of the expanded route storage unit, reading, when the vehicle passes a place sufficiently close to a particular one of the pass points of the expanded route storage unit, the latest value of the current time instant from the current time instant storage unit as a read current time instant, and writing, as an actual pass time instant, the read current time instant into the actual pass time instant storage area of the expanded route storage unit in correspondence to the particular one of the pass points of the expanded route storage unit;

a tenth step of calculating, supplied with the latest value of the current time instant from the current location storage unit and with the latest value of the current location information from the current location storage unit, a scheduled pass time instant for a next scheduled pass point of the pass points of the expanded route storage unit and the location of the next scheduled pass point;

an eleventh step of comparing the time information and the location information of the stored broadcast program of the broadcast program storage unit with the scheduled pass time instant for the next scheduled pass point and the location of the next scheduled pass point to select the stored broadcast program as a selected broadcast program when the stored broadcast program has the time information and the location information coincident with the scheduled pass time instant for the next scheduled pass point and the location of the next scheduled pass point; and a twelfth step of reproducing the selected broadcast program.

According to a fifth aspect of the present invention, there is provided a recording medium recording a program for making a computer execute a route-adaptive on-demand radio communication method which is for a user of a vehicle and which is for providing, by making use of one of digital satellite radio broadcasting and digital surface wave radio broadcasting simultaneously broadcasted to unspecified recipients, the user with particular information matching a current time instant and a current location of the vehicle and matching desired information preliminarily registered by the user, the method comprising:

a first step of making a digital broadcasting apparatus (11) of a broadcasting station periodically broadcast a plurality of broadcast programs by making use of the one of the digital satellite radio broadcasting and the digital surface wave radio broadcasting, each of the broadcast programs comprising a program content, a type information representative of a content type of the program content, and time information representative of a time zone during which the program content is valid, and location information representative of a location where the program content is valid;

a second step of making a favorite storage unit (13) store a desired type of information requested by the user;

a third step of making a route storage unit (14) store pass points in a route, locations of the pass points, and a time interval required between every adjacent ones of the pass points by the user;

a fourth step of making a current time instant storage unit (17) hold a latest value of a current time instant;

a fifth step of making a current location storage unit (18) hold a latest value of current location information;

a sixth step of receiving each of the broadcast programs;

a seventh step of comparing the type information of each of the broadcast programs with the desired type of the favorite storage unit and comparing the location information of each of the broadcast programs with the location of each of the pass points of the route storage unit to select a matched one of the broadcast programs that has the type information coincident with the desired type of the favorite storage unit and the location information coincident with the location of each of the pass points of the route storage unit;

an eighth step of making a broadcast program storage unit (16) store the matched one of the broadcast programs as a stored broadcast program;

a ninth step of periodically comparing the time information and the location information of the stored broadcast program of the broadcast program storage unit with the latest values of the current time instant storage unit and the current location storage units respectively, to select the stored broadcast program as a selected broadcast program when the stored broadcast program has the time information and the location information coincident with the latest values held in the current time instant storage unit and the current location storage unit; and a tenth step of reproducing the selected broadcast program, a route-adaptive on-demand radio communication method for selecting, from digital satellite radio broadcasting or digital surface wave radio broadcasting simultaneously broadcasted to unspecified recipients, particular information matching a current time instant and a current location of the vehicle and matching desired information preliminarily registered by the user, the method comprising:

According to a sixth aspect of the present invention, there is provided a recording medium recording a program for making a computer execute a route-adaptive on-demand radio communication method which is for a user of a vehicle and which is for providing, by making use of one of digital satellite radio broadcasting and digital surface wave radio broadcasting simultaneously broadcasted to unspecified recipients, the user with particular information matching a current time instant and a current location of the vehicle and matching desired information preliminarily registered by the user, the method comprising:

a first step of making a digital broadcasting apparatus (11) of a broadcasting station periodically broadcasting a plurality of broadcast programs by making use of the one of the digital satellite radio broadcasting and the digital surface wave radio broadcasting, each of the broadcast programs comprising a program content, a type information representative of a content type of the program content, and time information representative of a time zone during which the program content is valid, and location information representative of a location where the program content is valid;

a second step of making a favorite storage unit (13) store a desired type of information requested by the user;

a third step of making an expanded route storage unit (24) store pass points in a route, locations of the pass points, and a time interval required between every adjacent ones of the pass points by the user, the expanded route storage unit having an actual pass time instant storage area;

a fourth step of making a current time instant storage unit (17) hold a latest value of a current time instant;

a fifth step of making a current location storage unit (18) hold a latest value of current location information;

a sixth step of receiving each of the broadcast programs;

a seventh step of comparing the type information of each of the broadcast programs with the desired type of the favorite storage unit and comparing the location information of each of the broadcast programs with the location of each of the pass points of the expanded route storage unit to select a matched one of the broadcast programs that has the type information coincident with the desired type of the favorite storage unit and the location information coincident with the location of each of the pass points of the expanded route storage unit;

an eighth step of making a broadcast program storage unit (16) store the matched one of the broadcast programs as a stored broadcast program;

a ninth step of comparing the latest value of the current location information of the current location storage unit with the location of each pass point of the expanded route storage unit, reading, when the vehicle passes a place sufficiently close to a particular one of the pass points of the expanded route storage unit, the latest value of the current time instant from the current time instant storage unit as a read current time instant and writing, as an actual pass time instant, the read current time instant into the actual pass time instant storage area of the expanded route storage unit in correspondence to the particular one of the pass points of the expanded route storage unit;

a tenth step of calculating, supplied with the latest value of the current time instant from the current location storage unit and with the latest value of the current location information from the current location storage unit, a scheduled pass time instant for a next scheduled pass point of the pass points of the expanded route storage unit and the location of the next scheduled pass point;

an eleventh step of comparing the time information and the location information of the stored broadcast program of the broadcast program storage unit with the scheduled pass time instant for the next scheduled pass point and the location of the next scheduled pass point to select the stored broadcast program as a selected broadcast program when the stored broadcast program has the time information and the location information coincident with the scheduled pass time instant for the next scheduled pass point and the location of the next scheduled pass point; and a twelfth step of reproducing the selected broadcast program.

PREFERRED EMBODIMENT OF THE INVENTION

Figure 1:
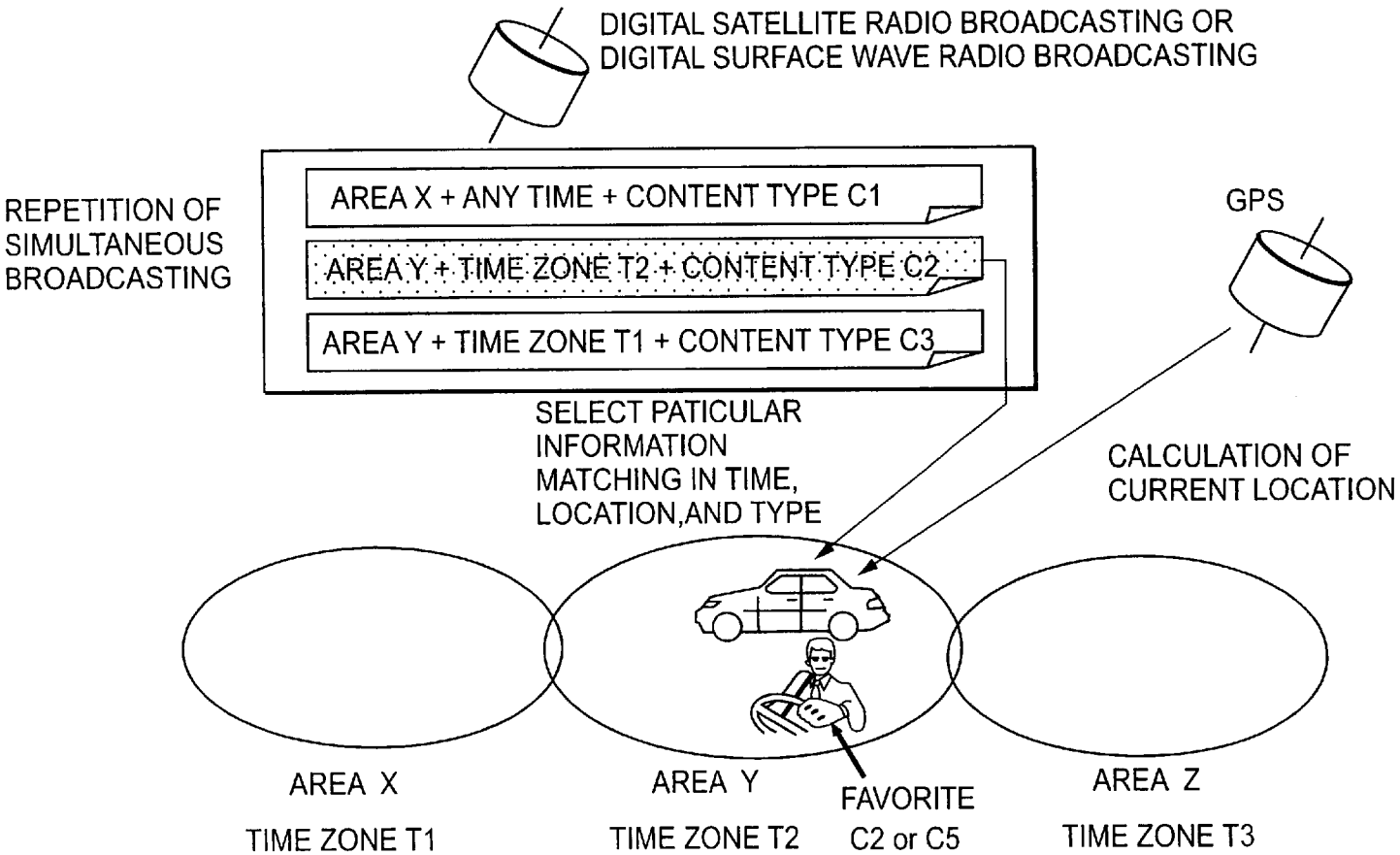
FIG. 1 is a view for describing the principle of the present invention.

First of all, the principle of the present invention will be described with reference to the drawing.

Referring to FIG. 1, a set of broadcast programs each of which contains an information content, time information, and location information is repeatedly and simultaneously broadcasted by digital satellite broadcasting or digital surface wave broadcasting. On the other hand, an on-vehicle PC holds a desired information content preliminarily supplied by a driver or user. In addition to the desired information content, a current time instant and a current location are available from a clock and the GPS (Global Positioning System), respectively. Among the broadcast programs which are simultaneously broadcasted, relevant information matching the desired information, the current time instant, and the current location is selected and presented to the user.

In the above-mentioned manner, it is possible to provide those information such as "Go out through 'the next highway exit' and you will find XX, a favorite restaurant", "Only one gas station can be found before arriving 'XXX as a next place of visit", "Favorite museum will be found 'on the way you will pass within one hour's drive from now'", and so on.

When the information is provided in the above-mentioned manner, it is important to enable the expressions such as "the next exit", "XXX as a next place of visit", or "on the way you will pass within one hour's drive from now". In order to say "the next exit", it is required to identify "the first exit in the forward direction from the current location". In order to say "the next place of visit", it is required to identify "the place scheduled to be visited next in the forward direction from the current location". In order to say "you will pass within one hour's drive from now", it is required to identify "the way from the current location and the area reached within one hour in the forward direction".

These information can be assumed in presence of route information including a list of pass points, the location information thereof, and average time intervals required between every adjacent ones of the pass points. In a recent car navigation system, the route information can automatically be created if the information of the start point and the destination point is given. Alternatively, the route information can be manually prepared and entered by the user by checking a map. Exit information for the highway (necessary for identifying "the next exit") can be copied from the database or the map. Although the route information is used in the present invention, the manner how to prepare the route information is not restricted in the present invention. The present invention includes the function of preparing the route information.

Figure 2:
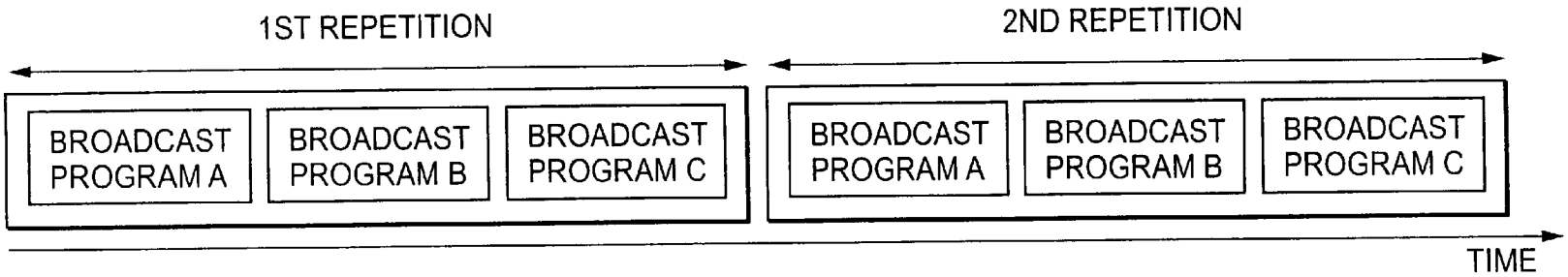
FIG. 2 is a view for describing the manner of broadcasting of broadcast programs.

Referring to FIG. 2, according to the present invention, same programs are repeatedly transmitted from a broadcasting station. In the illustrated example, three broadcast programs A, B, and C are repeatedly transmitted.

Next, description will be made about the principle of each of the broadcast programs with reference to the drawing.

The content of each broadcast program broadcasted by the digital broadcasting can be expressed by, for example, XML (Extensible Markup Language) which is increasingly spread on the WWW. The XML is a language which can express the content of a document by a set of pairs of attribute tags and attribute values thereof (see Web Page of World Wide Web Consortium "Extensible Markup Language, 1.0", http://www.w3.org/TR/PR-xml-971208).

The specification of the XML was proposed in December, 1997 by the World Wide Web Consortium (see Web Page of World Wide Web Consortium "Extensible Markup Language, 1.0", http://www.w3.org/TR/PR-xml-971208), the organization which determines the standard for the WWW.

Figure 3:
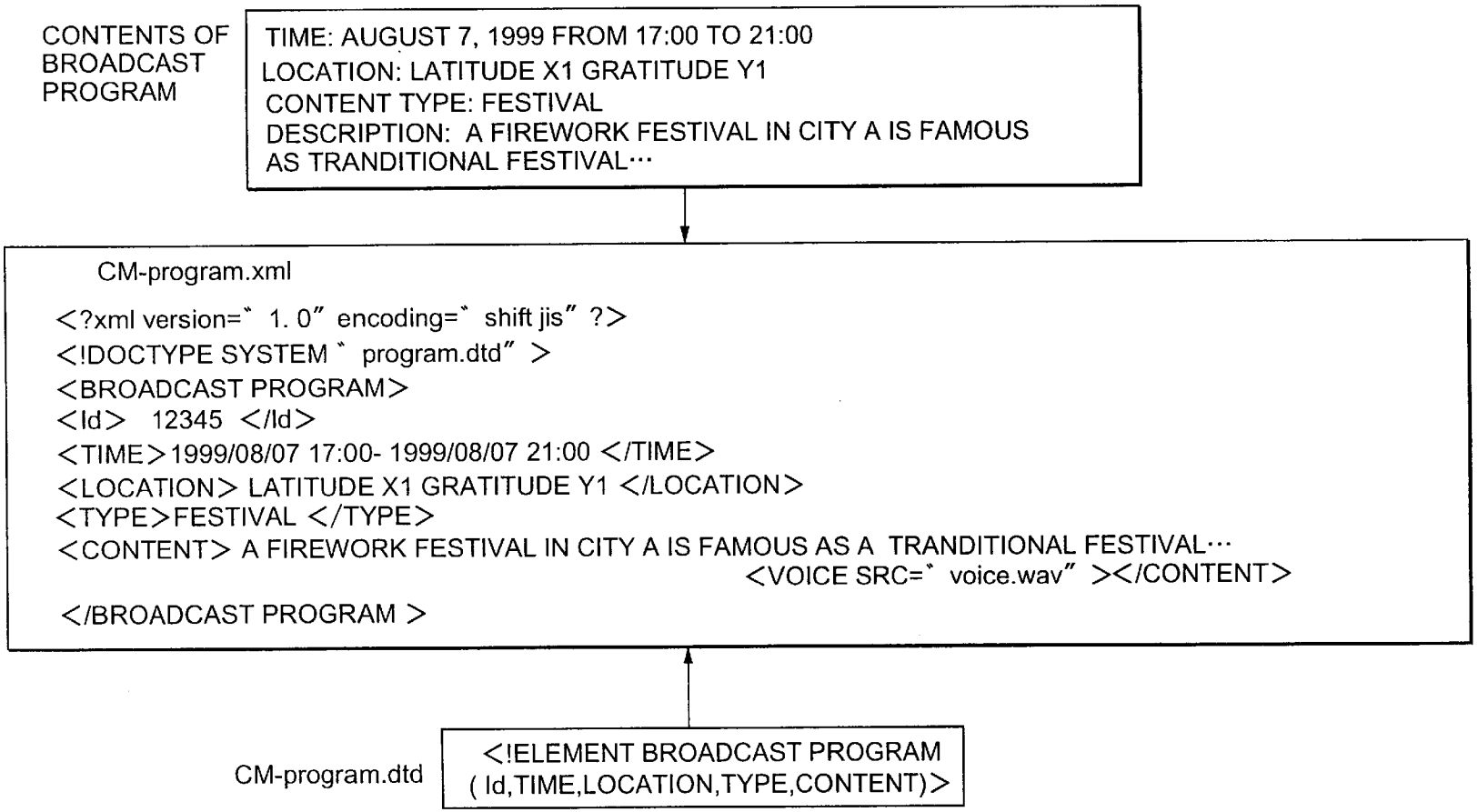
FIG. 3 is a view for describing the content of a broadcast program.

Referring to FIG. 3, the broadcast program is described by the use of XML. The XML defines a format of the document as specified by a DTD (Document Type Definition) file (Program. dtd). The format "Program" includes four fields, i.e., "time", "location", "type", and "content" fields. The contents of individual broadcast programs are stored in separate XML files in one-to-one correspondence. In FIG. 3, the information of a fireworks festival is described in the XML file (Program. xml) in accordance with the format specified by the DTD file (Program.dtd).

In the Program.xml, <voice SRC="voice.wav"> in the "content" field represents a voice file "voice.wav" in which the explanation of the fireworks festival is recorded. This file is broadcasted together with the Program. xml.

It is assumed here that the user or the driver preliminarily registers his desire for "festival" information. If he goes to the city A on Aug. 7, 1999, between 17:00 to 21:00, the above-mentioned information of the fireworks festival is presented to the driver. The time information in the broadcast program and the current time instant can easily be collated or matched.

In FIG. 3, the location information in the broadcast program is given as longitude/latitude information. Therefore, the location information in the broadcast program and the current location can easily be collated or matched in case where the current location information is obtained from the GPS. With respect to the content type information in the broadcast program, collation or matching is easy If a finite number of types are defined for selection therefrom.

Next, description will be made in detail about a first embodiment of the present invention with reference to the drawing.

Figure 4:
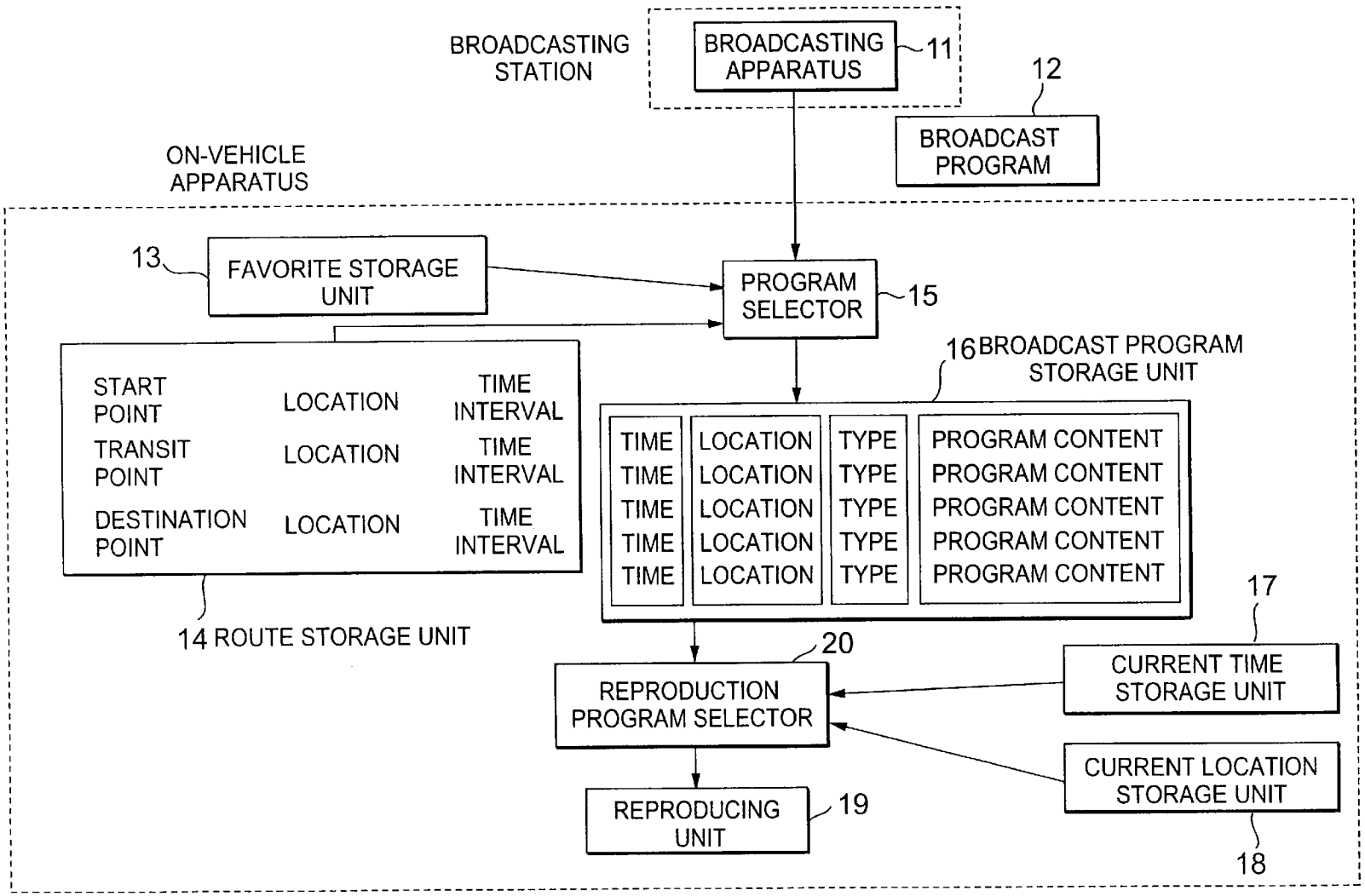
FIG. 4 is a block diagram showing a communication system according to a first embodiment of the present invention.

Referring to FIG. 4, a communication system according to the first embodiment of the invention includes a broadcasting apparatus 11, a broadcast program 12, a favorite storage unit 13, a route storage unit 14, a program selector 15, a broadcast program storage unit 16, a current time instant storage unit 17, a current location storage unit 18, a reproduction unit 19, and a reproduction program selector 20.

The broadcast program 12 is described by the use of XML as already mentioned with reference to FIG. 3. An item "broadcast program" includes various fields, i.e., "Id", "time", "location", "type", and "content" fields. The values of these fields are determined by a broadcast station. The "Id" field stores the name uniquely assigned to each individual broadcast program managed by the broadcast station. With respect to one of the broadcast programs as a particular program, the "time" field contains the description of a time period during which the particular broadcast program is valid or effective. The "location" field contains the description of the location relating to the particular broadcast program. The "type" field contains the description of a content classification code of the particular broadcast program. For example, the type classification codes correspond to restaurants, convenience stores, shopping malls, DIY shops, hospitals, amusement parks, and museums.

Suppose a restaurant as a sponsor wishes to advertise its special sale during the lunchtime. In this case, the "time" field contains the description of a specific time zone corresponding to the lunchtime. The "location" field contains the address of the restaurant. The "type" field contains the indication of "category of restaurant". The "content" field stores the content of the special sale as voice data, for example, in a MPEG format. In case where the restaurant wishes to broadcast ordinary restaurant information without such special sale for the lunchtime as the specific time zone, the "time" field stores the description of "any time". Sometimes, the "time" field may store the month/day information instead of the hour information. For example, in case where a special exhibition is held at a museum, the "time" field contains the description, such as "from May 10, 2000 to Jun. 10, 2000".

Next, the operation of the communication system according to the first embodiment of the present invention will be described with reference to the drawing.

Figure 5:
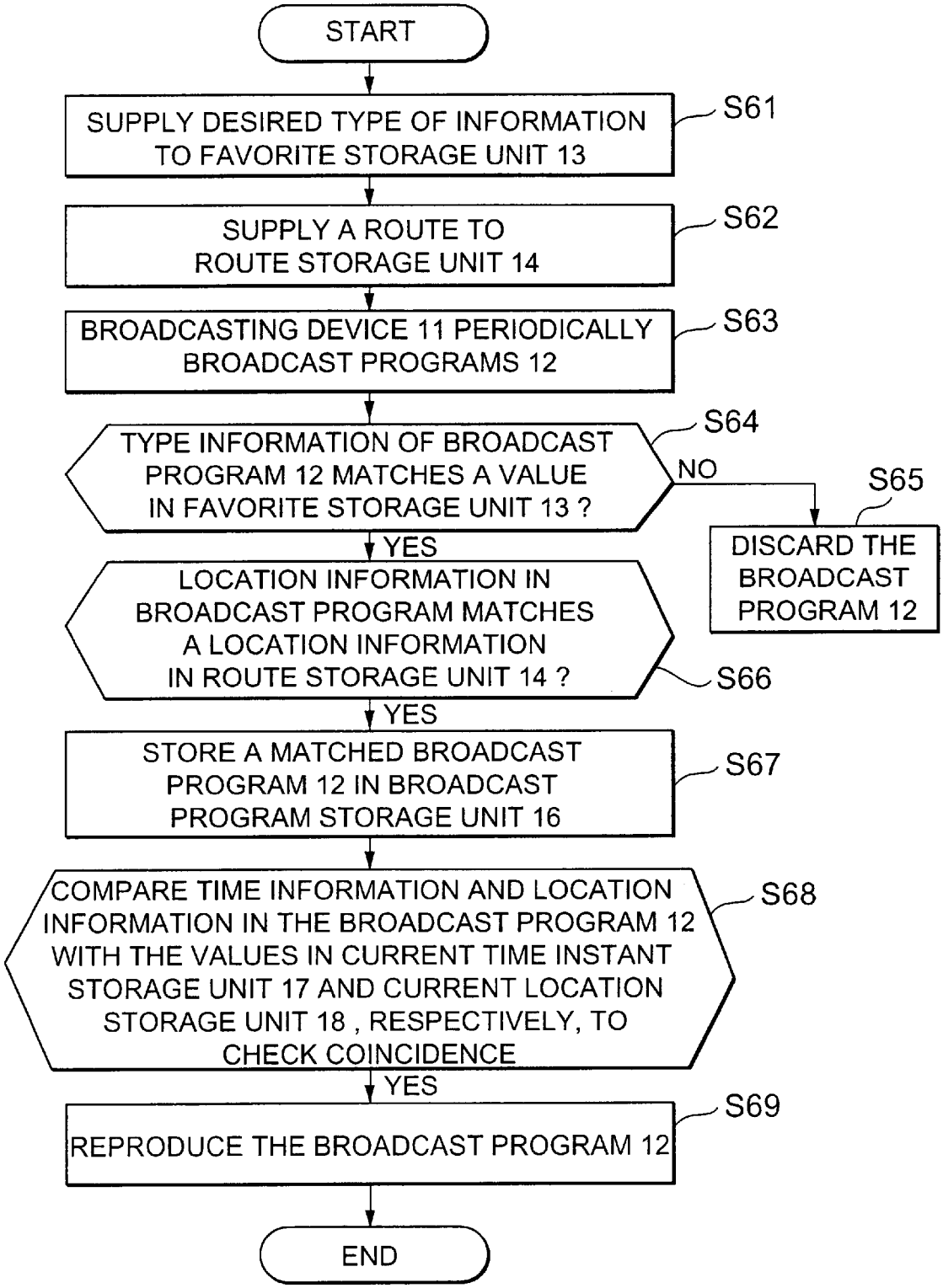
FIG. 5 is a flow chart for describing an operation of a first embodiment of the present invention.

Referring to FIG. 5, the favorite storage unit 13 is a memory storing a desired type of information requested by the user. The desired type of information stored in the favorite storage unit 13 is similar to that stored in the "type" field of the broadcast program 12. The user preliminarily registers the desired type of information to the favorite storage unit 13 (step S61 in FIG. 5).

Furthermore, the user preliminarily supplies the route storage unit 14 with location information about locations of a start point, an intermediate or transit point, and a destination point which are pass points in a scheduled route as well as an average time interval required between every adjacent pass points (an estimated time interval required between a particular pass point and a next pass point) (step S62 in FIG. 5). Herein, the location information can be given by the latitude and the gratitude.

The broadcasting apparatus 11 is installed in the broadcast station in case of the digital surface wave broadcasting and is installed in an artificial satellite in case of the digital satellite broadcasting. As shown in FIG. 2, the broadcasting apparatus 11 periodically broadcasts a plurality of broadcast programs 12 (step S63 in FIG. 5).

The program selector 15 continuously receives the broadcast programs 12. Upon receiving one of the broadcast programs 12 temporarily referred to as a particular broadcast program, the program selector 15 compares the type information described in the particular broadcast program with the desired type contained in the favorite storage unit 13 to check coincidence or incoincidence (step S64 in FIG. 5). Upon incoincidence therebetween (NO in step S64 in FIG. 5), the particular broadcast program 12 is discarded (step S65 in FIG. 5).

Upon coincidence therebetween (YES in step S64 in FIG. 5), the location information described in the particular broadcast program 12 is compared with the location information of each of the start point, the transit points, and the destination point in the route storage unit 14 (step S66 in FIG. 5). If coincidence is detected with the location information of any one of the above-mentioned points (YES in step S66 in FIG. 5), the program selector 15 delivers the particular broadcast program 12 as a matched broadcast program 12 to the broadcast program storage unit 16 to be stored therein (step S67 in FIG. 6).

Herein, the above-mentioned comparison of the location information may be carried out in various manners. For example, if the location information described in the particular broadcast program 12 is included within a radius N (kilometers) from a particular location having the latitude and the gratitude given by the location information stored in the route storage unit 14, it is possible to "judge coincidence". The radius N can be preliminarily registered in the program selector 15 by the user.

The broadcast program storage unit 16 is supplied from the program selector 15 with a plurality of matched broadcast programs, i.e., a plurality of sets of the time information, the location information, the type information, and the program content and stores the matched broadcast programs.

The reproduction program selector 20 periodically refers to the broadcast program storage unit 16 to compare the time information and the location information of each of the matched broadcast programs 12 stored therein with a current time instant value in the current time instant storage unit 17 and a current location value in the current location storage unit 18, respectively (step S66 in FIG. 5). If a specific one of the matched broadcast programs 12 is coincident (YES in step S68 in FIG. 5), the specific broadcast program 12 is selected as a selected broadcast program to be delivered to the reproduction unit 19.

Herein, the current time instant storage unit 17 stores, as the current time instant value, a current time instant read from a clock. The current time instant value is renewed, for example, every 1 minute. The current location storage unit 18 stores, as the current location value, the current location information read from the GPS in the form of the gratitude and the latitude. Likewise, the current location value is renewed, for example, every 1 minute.

Then, the reproduction unit 19 reproduces the selected broadcast program 12 selected by the reproduction program selector 20 (step S69 in FIG. 5). The selected broadcast program 12 includes a voice file (Wav) or a MPEG file, and the reproduction unit 19 can reproduce the selected broadcast program 12 by the use of the reproducing function corresponding to a specific format of the file.

Next, a second embodiment of the present invention will be described in detail with reference to the drawing.

Figure 6:
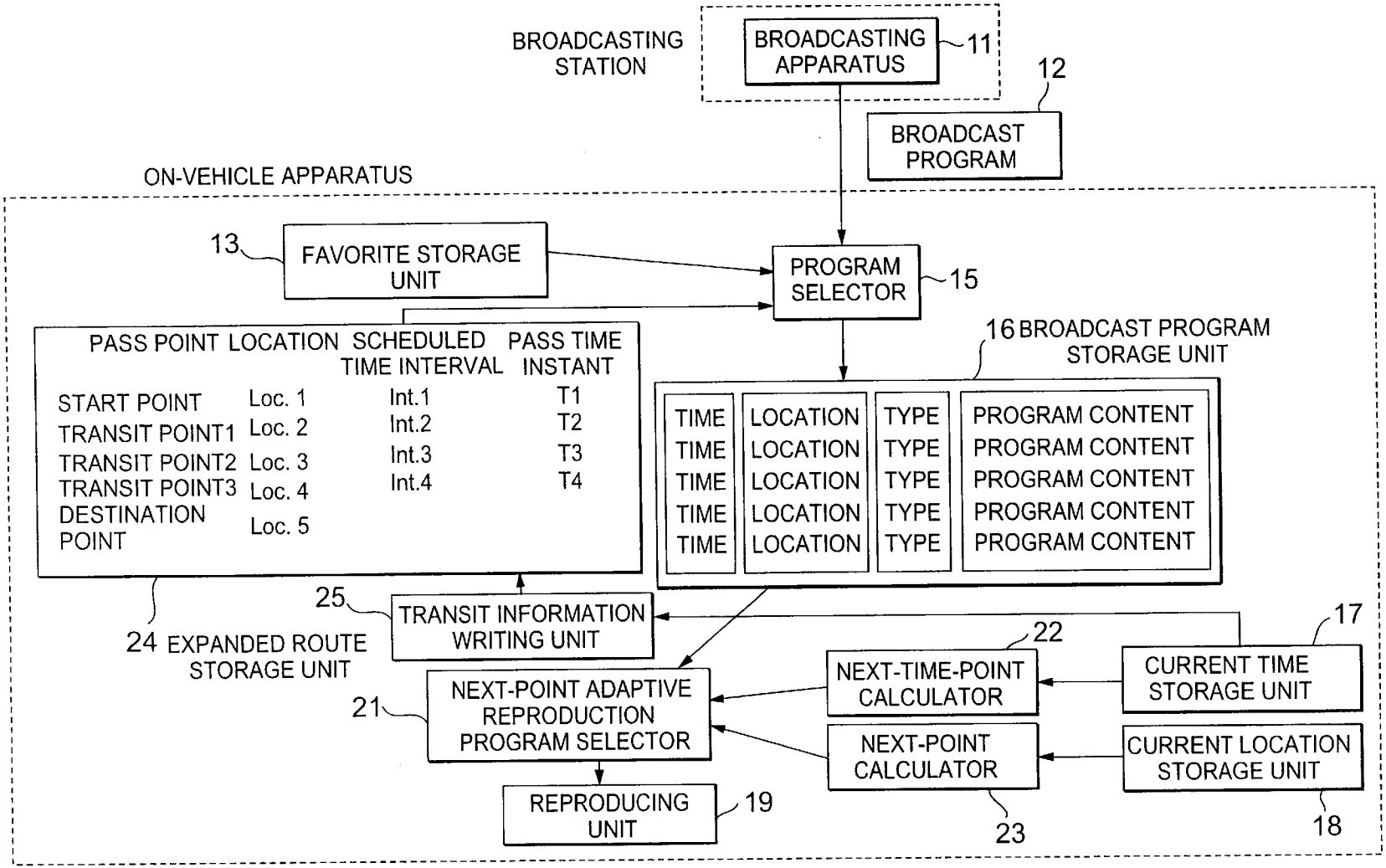
FIG. 6 is a block diagram showing a second embodiment of the present invention.

Referring to FIG. 6, a communication system according to the second embodiment of the present invention includes a broadcasting apparatus 11, a broadcast program 12, a favorite storage unit 13, an expanded route storage unit 24, a program selector 15, a broadcast program storage unit 16, a current time instant storage unit 17, a current location storage unit 18, a reproduction unit 19, a next-point-adaptive reproduction program selector 21, a next-time-point calculator 22, a next-point calculator 23, and a pass information writing unit 25.

Each of the broadcasting apparatus 11, the broadcast program 12, the favorite storage unit 13, the program selector 15, the broadcast program storage unit 16, the current time instant storage unit 17, the current location storage unit 18, and the reproduction unit 19 is similar to that described in conjunction with the first embodiment.

In this embodiment, the reproduction program selector 20 and the route storage unit 14 are replaced by the next-point-adaptive reproduction program selector 21 and the expanded route storage unit 24, respectively. The next-time-point calculator 22 and the next-point calculator 23 are newly added components which are not included in the first embodiment.

The expanded route storage unit 24 includes a plurality of pass points (a start point, a plurality of transit points 1 to 3, and a destination point), a plurality of locations (Loc 1 to Loc 5), a plurality of scheduled time intervals (Int 1 to Int 4), and a plurality of pass time instants (T1 to T4). Herein, each of the locations represents the location of each pass point while each of the scheduled time intervals represents a time interval which is estimated to be required between each particular pass point to each next pass point.

Next, description will be made about the operation of the communication system according to the second embodiment of the present invention.

The expanded route storage unit 24 is preliminarily supplied by the user with the pass points, the locations, and the scheduled time intervals required between every adjacent ones of the pass points. For example, the location information can be given by a combination of the gratitude and the latitude.

In the manner similar to the first embodiment, a plurality of the broadcast programs 12 are broadcasted by the broadcasting apparatus 11 and the program selector 15 selects a particular one of the broadcast programs which matches the content of the favorite storage unit 13. Next, the program selector 15 compares the location information described in the particular broadcast program 12 with the location information representing the location of each of the pass points stored in the expanded route storage unit 24. Upon coincidence, the particular broadcast program 12 is stored in the broadcast program storage unit 16 as a matched broadcast program. In the similar manner, a plurality of matched broadcast programs are stored in the broadcast storage unit 16.

Next, the pass information writing unit 25 writes a time instant value into the expanded route storage unit 24 as a pass time instant when the user passes each pass point specified by the expanded route storage unit 24. Specifically, the current location value in the current location storage unit 18 and the location information of each pass point in the expanded route storage unit 24 are continuously compared with each other. When the user passes a particular place sufficiently close to any one of the pass points specified in the expanded route storage unit 24, a current time instant is read from the current time instant storage unit 17 and is written into the expanded route storage unit 24 as the pass time instant of the pass point in consideration.

In this event, whether or not the particular place is sufficiently close to the pass point is judged in accordance with a predetermined rule. For example, the place is judged to be sufficiently close to the pass point when the distance therebetween is shorter than 5 km. Following the predetermined rule, the pass information writing unit 25 makes a judgment upon the above-mentioned comparison.

The next time point calculator 22 and the next point calculator 23 are supplied with the current time instant and the current location from the current time instant storage unit 17 and the current location storage unit 18, respectively, and calculate, from the pass points stored in the expanded route storage unit 24, a scheduled next pass point and a scheduled pass time instant therefor.

Next, description will be made about the calculation of the scheduled next pass point and the scheduled pass time instant.

Figure 7:
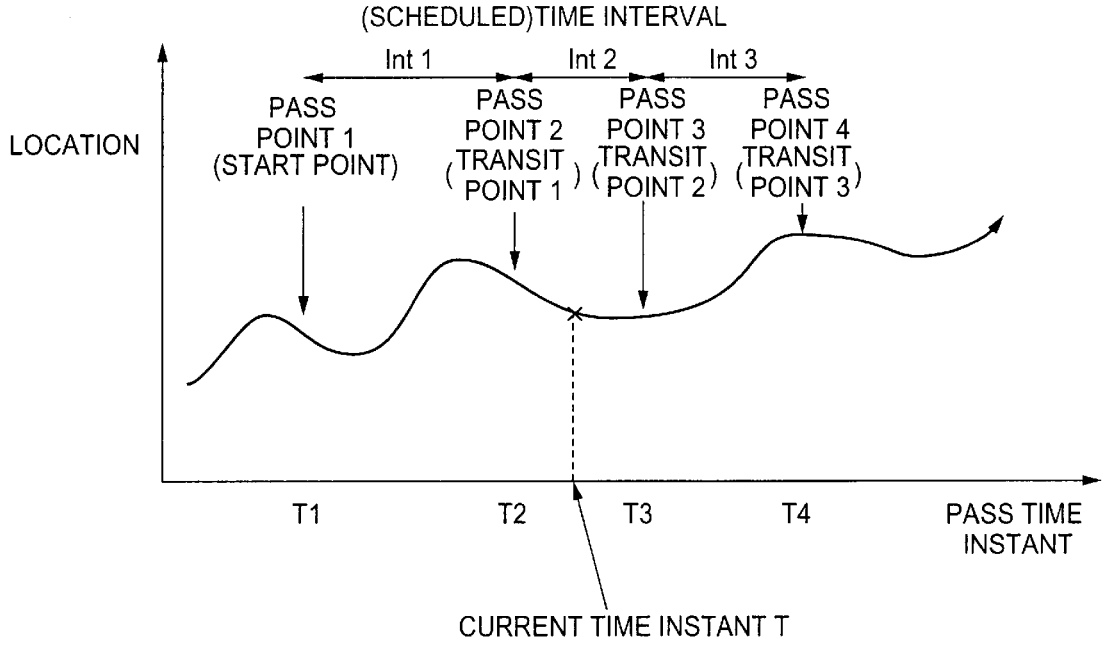
FIG. 7 is a view for describing an operation of a second embodiment of the present invention.

Referring to FIG. 7, an abscissa represents a time instant. Following the lapse of time during the drive, the time instant proceeds as T1, T2, T3, and T4. An ordinate conceptually represents the location. Specifically, the driver passes a pass point 1 (start point), a pass point 2 (transit point 1), a pass point 3 (transit point 2), and a pass point 4 (transit point 3) at the time instants T1. T2. T3, and T4, respectively.

For example, the scheduled time interval required between the pass points 2 and 3 is represented by Int 2. When the driver passes the pass point 2 at the time instant T2, the scheduled pass time instant for the pass point 3 is represented by (T2+Int2). However, the scheduled pass time instant is no more than a calculated result and may possibly be incoincident with an actual pass time instant (depicted by T3 in FIG. 7).

Assume that the current time instant is T and the current location is somewhere between the pass points 2 and 3. In this case, the next point calculator 23 finds a last pass point already passed at a last pass time instant before the current time instant T. In the example being illustrated in FIG. 7, the last pass time instant is T2 and the last pass point is the pass point 2.

Referring back to FIG. 6, the expanded route storage unit 24 stores the description that a pass point next to the pass point 2 is the pass point 3 and the scheduled time interval required therebetween is Int2. Based on this information, the next point calculator 23 calculates the "pass point 3" as the scheduled next pass point The next time point calculator 22 calculates the scheduled pass time instant (T2+Int2) for the arrival to the pass point 3. The results of calculation by the next point calculator 23 and the next time point calculator 22 are supplied to the next-point-adaptive reproduction program selector 21.

The reproducing program selector 21 periodically refers to the broadcast program storage unit 16 and compares the time information and the location information of each of the matched broadcast programs 12 stored therein with the above-mentioned results of calculation of the next time point calculator 22 and the next point calculator 23, respectively, to select one (or ones) of the matched broadcast programs 12 as a selected broadcast program 12. The selected broadcast program 12 is delivered to the reproduction unit 19.

Then, the reproduction unit 19 reproduces the selected broadcast program 12 supplied from the reproduction program selector 21.

Now, description will be made about a third embodiment of the present invention.

Referring to FIG. 5, a method according to the third embodiment of the present invention comprises: a first step (step S61 in FIG. 5) in which the user supplies the desired type of information to the favorite storage unit 13;

a second step (step S62 in FIG. 5) in which the user supplies the route storage unit 14 with a start point, transit points, and a destination point in a scheduled route, and an average time interval required between every adjacent ones of the pass points;

a third step (step S63 in FIG. 5) in which the broadcast programs 12 are periodically broadcasted as illustrated in FIG. 2;

a fourth step (step S64 in FIG. 5) in which, upon reception of one of the broadcast programs 12 as a particular broadcast program, the type information described in the particular broadcast program 12 is compared with the desired type stored in the favorite storage unit 13 to check coincidence or incoincidence;

a fifth step (step S65 in FIG. 5) in which the particular broadcast program 12 is discarded if incoincidence is judged (NO in step S64 in FIG. 5);

a sixth step (step S66 in FIG. 5) in which the location information described in the particular broadcast program 12 with the location information of each of the start point, the transit points, and the destination point stored in the route storage unit 14 if coincidence is judged (YES in step S64 in FIG. 5);

a seventh step (step S67 in FIG. 5) in which the particular broadcast program 12 is stored in the broadcast program storage unit 16 as a matched broadcast program 12 if coincidence is judged (YES in step S66 in FIG. 5);

an eighth step (step S68 in FIG. 5) in which the broadcast program storage unit 16 is periodically referred to and the time information and the location information of the matched broadcast program 12 stored therein are compared with latest values held in the current time storage unit 17 and the current location storage unit 18, respectively; and a ninth step (step S69 in FIG. 5) in which the matched program 12 is selected as a selected broadcast program and reproduced if coincidence is judged (YES in step S68 in FIG. 5).

Next, description will be made about a fourth embodiment of the present invention.

Referring again to FIG. 5, a method according to the fourth embodiment of the present invention comprises:

a first step (step S61 in FIG. 5) in which the user supplies the desired type of information to the favorite storage unit 13;

a second step (step S62 in FIG. 5) in which the user supplies the expanded route storage unit 24 with pass points (a start point, transit points 1 to 3, and a destination point) in a scheduled route, locations (Loc 1 to Loc 5), a scheduled time interval (Int 1 to Int 4) required between every adjacent ones of the pass points;

a third step (step S63 in FIG. 5) in which the broadcast programs 12 are periodically broadcasted as illustrated in FIG. 2;

a fourth step (step S64 in FIG. 5) in which, upon reception of one of the broadcast programs 12 as a particular broadcast program, the type information described in the particular broadcast program 12 is compared with the desired type stored in the favorite storage unit 13 to check coincidence or incoincidence;

a fifth step (step S65 in FIG. 5) in which the particular broadcast program 12 is discarded if incoincidence is judged (NO in step S64 in FIG. 5), a sixth step (step S66 in FIG. 5) in which the location information described in the particular broadcast program 12 with the location information of each of the start point, the transit points, and the destination point stored in the expanded route storage unit 24 if coincidence is judged (YES in step S64 in FIG. 5), a seventh step (step S67 in FIG. 5) in which the particular broadcast program 12 stored in the broadcast program storage unit 16 as a matched broadcast program 12 if coincidence is judged (YES in step S66 in FIG. 5), an eighth step in which the latest value held in the current location storage unit 18 with the location information of each pass point stored in the expanded route storage unit 24, and, when the user passes a place sufficiently close to any one of the pass points stored in the expanded route storage unit 24, the current time instant is read from the current time instant storage unit 17 and written into the expanded route storage unit 24;

a ninth step in which a next scheduled pass point, among the pass points stored in the expanded route storage unit 24, and a scheduled pass time instant therefor are calculated with reference to the current time instant and the current location supplied from the current time instant storage unit 17 and the current location storage unit 18, respectively;

a tenth step in which the broadcast program storage unit 16 is periodically referred to and the time information and the location information contained in the matched broadcast program stored therein are compared with the result of calculation in the ninth step to select the matched broadcast program as a selected broadcast program; and an eleventh step in which the selected broadcast program 12 selected in the tenth step is reproduced.

Next, description will be made about a fifth embodiment of the present invention with reference to the drawing.

Figure 8:
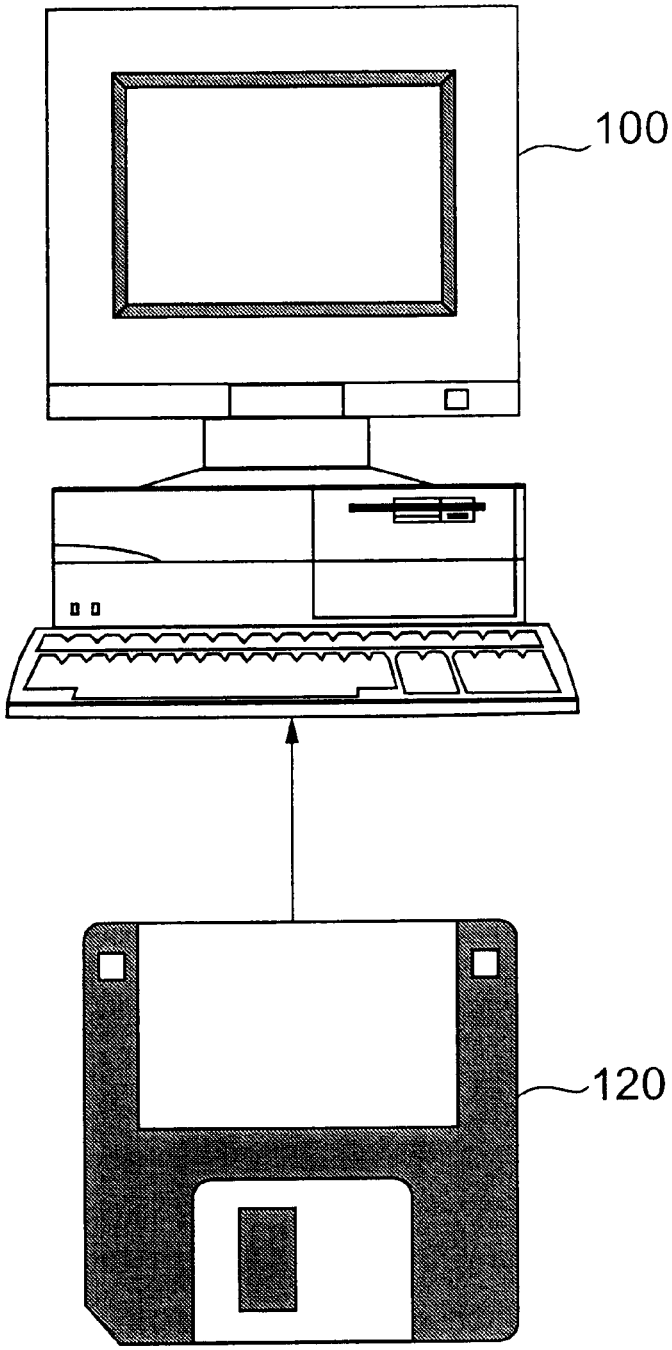
FIG. 8 is a view for describing fifth and sixth embodiments of the present invention.

Referring to FIG. 8, a recording medium 120 according to the fifth embodiment of the present invention stores a program for making a computer 100 (for example, a computer including a series of components 13 through 20 as illustrated in FIG. 4) execute each of the steps described in conjunction with the third embodiment.

Next, description will be made about a sixth embodiment of the present invention with reference to the drawing.

Referring to FIG. 8, a recording medium 120 according to the sixth embodiment of the present invention stores a program for making a computer 100 (for example, a computer including a series of components 13 through 25 illustrated in FIG. 6) execute each of the steps described in conjunction with the fourth embodiment.

Although the foregoing description has been made about the apparatus mounted on the automobile for receiving the broadcast programs 12, the invention is also applicable to other vehicles such as a motorcycle, a bicycle, and a tricycle.

As a first advantage of the present invention, the information matching the current location of the vehicle can be obtained with high accuracy.

This is because the location information of each transit point in the user's route preliminarily stored is compared with the current location of the user's vehicle (for example, supplied from the GPS) to select the selected broadcast program to be reproduced.

As a second advantage of the present invention, only the information relevant to the use as route can be extracted so that the use of the system is conveniently and smartly performed.

This is because the system comprises the means for storing the route as well as the means for extracting only the information matching the content of the route stored therein.

As a third advantage of the present invention, the information of a place of an immediate visit or passage can be timely extracted so that the use of the system is conveniently and smartly performed. For example, at the time when the user passes a particular exit on the highway, information of restaurants or amusement parks around the next exit can be extracted from the broadcast program to provide the user with the information such as "You will find a zoo around the next exit".

This is because the system comprises the means for storing the route and the means for generating the scheduled pass time instant to reproduce the information relevant to the next place of visit.

What is claimed is:

1. A route-adaptive on-demand radio communication system for a user of a vehicle and which is for providing, by using one of digital satellite radio broadcasting and digital surface wave radio broadcasting simultaneously broadcasted to unspecified recipients, said user with particular information matching a current time instant and a current location of the vehicle and matching desired information preliminarily registered by said user, said system comprising:

a digital broadcasting apparatus, in a broadcasting station, for periodically broadcasting a plurality of broadcast programs by using said one of the digital satellite radio broadcasting and the digital surface wave radio broadcasting, each of said broadcast programs comprising a program content, a type information representative of a content type of said program content, and time information representative of a time period during which said program content is valid, and location information representative of a location where said program content is valid;

a favorite storage for storing a desired type of information;

a route storage in which pass point identifiers for a route, locations of said pass points, and a time interval between said pass points are stored;

a program selector for receiving each of said broadcast programs, for comparing the type information of each of said broadcast programs with the desired type stored in the favorite storage, for comparing the location information of each of said broadcast programs with the location of each of said pass points stored in said route storage, and for selecting a matched one of said broadcast programs that includes the type information coincident with the desired type of said favorite storage and the location information coincident with the location of each of said pass points of said route storage;

a broadcast program storage for storing said matched one of the broadcast programs as a stored broadcast program;

a current time instant storage for holding a current time instant;

a current location storage for holding a current location information;

a reproduction program selector for comparing the time information and the location information of said stored broadcast program of said broadcast program storage with the values held in said current time instant storage and said current location storage, respectively, and for selecting said stored broadcast program as a selected broadcast program when said stored broadcast program had the time information and the location information coincident with the values held in said current time instant storage and said current location storage; and a reproduction unit for reproducing the selected broadcast program selected by said reproduction program selector.

2. The system of claim 1, wherein the time intervals stored in said route storage comprise time intervals between every adjacent ones of said pass points, wherein the current time instant comprises a latest value of a current time instant and the current location comprises a latest value of a current location.

3. The system of claim 1, wherein the reproduction program selector periodically compares the time information and the location information.

4. A route-adaptive on-demand radio communication system which is for a user of a vehicle and which is for providing, by using one of digital satellite radio broadcasting and digital surface wave radio broadcasting simultaneously broadcasted to unspecified recipients, said user with particular information matching a current time instant and a current location of the vehicle and matching desired information preliminarily registered by said user, said system comprising:

a digital broadcasting apparatus, in a broadcasting station, for periodically broadcasting a plurality of broadcast programs by using said one of the digital satellite radio broadcasting and the digital surface wave radio broadcasting, each of said broadcast programs comprising a program content, a type information representative of a content type of said program content, and time information representative of a time period during which said program content is valid, and location information representative of a location where said program content is valid;

a favorite storage for storing a desired type of information;

a route storage in which pass point identifiers for route, locations of said pass points, a time interval between said pass points, and an actual pass time instant storage area;

a program selector for receiving each of said broadcast programs, for comparing the type information of each of said broadcast programs with the desired type stored in the favorite storage, for comparing the location information of each of said broadcast programs with the location of each of said pass points stored in said route storage, and for selecting a matched one of said broadcast programs that includes the type information coincident with the desired type of said favorite storage and the location information coincident with the location of each of said pass points of said route storage;

a broadcast program storage for storing said matched one of the broadcast programs as a stored broadcast program;

a current time instant storage for holding a current time instant;

a current location storage for holding current location information;

a pass information writing for writing, into the actual pass time instant storage area of said route storage in correspondence to each pass point stored in said route storage an actual pass time instant at which said vehicle actually passes each pass point stored in said route storage;

a next time point calculator for calculating, with reference to said route storage, a scheduled arrival time instant for the arrival to a next pass point next to a latest pass point at a latest pass time instant before a value of the current time instant held in said current time instant storage;

a next point calculator for calculating, with reference to said route storage, the location of said next pass point on the basis of a value of the current location information held in said current location storage;

a next-point-adaptive reproduction program selector for comparing the time information and the location information of said stored broadcast program of said broadcast program storage with a calculated result of said next time point calculator and said next point calculator, respectively, and for selecting said stored broadcast program as a selected broadcast program when said stored broadcast program includes the time information and the location information coincident with the calculated result of said next time point calculator and said next point calculator; and a reproduction unit for reproducing the selected broadcast program selected by said reproduction program selector.

5. The system of claim 4, wherein the time intervals stored in said route storage comprise time intervals between every adjacent ones of said pass points, wherein the current time instant comprises a latest value of a current time instant and the current location comprises a latest value of a current location.

6. The system of claim 4, wherein the next-point-adaptive reproduction program selector periodically compares the time information and the location information.

7. A route-adaptive on-demand radio communication method which is for a user of a vehicle and which is for providing, by using one of digital satellite radio broadcasting and digital surface wave radio broadcasting simultaneously broadcasted to unspecified recipients, said user with particular information matching a current time instant and a current location of the vehicle and matching desired information preliminarily registered by said user, said method comprising:

making a digital broadcasting apparatus of a broadcasting station periodically broadcast a plurality of broadcast programs by using one of the digital satellite radio broadcasting and the digital surface wave radio broadcasting, each of said broadcast programs comprising a program content, a type information representative of a content type of said program content, and time information representative of a time period during which said program content is valid, and location information representative of a location where said program content is valid;

making a favorite storage store a desired type of information requested by said user;

making a route storage store pass point identifiers for a route, locations of said pass points, and a time interval between said pass points;

making a current time instant storage hold a current time instant;

making a current location storage hold a current location information;

receiving each of said broadcast programs;

comparing the type information of each of said broadcast programs with the desired type of said favorite storage and comparing the location information of each of said broadcast programs with the location of each of said pass points of said route storage to select a matched one of said broadcast programs that includes the type information coincident with the desired type of said favorite storage and the location information coincident with the location of each of said pass points of said route storage;

making a broadcast program storage store said matched one of the broadcast programs as a stored broadcast program;

comparing the time information and the location information of said stored broadcast program of said broadcast program storage with the latest values of said current time instant storage and said current location storage, respectively, to select said stored broadcast program as a selected broadcast program when said stored broadcast program includes the time information and the location information coincident with the values held in said current time instant storage and said current location storage; and reproducing said selected broadcast program.

8. The method of claim 7, wherein the time intervals stored in said route storage comprise time intervals between every adjacent ones of said pass points, wherein the current time instant comprises a latest value of a current time instant and the current location comprises a latest value of a current location.

9. The method of claim 7, wherein the comparison between the time information and the location information occurs periodically.

10. A route-adaptive on-demand radio communication method which is for a user of a vehicle and which is for providing, by using one of digital satellite radio broadcasting and digital surface wave radio broadcasting simultaneously broadcasted to unspecified recipients, said user with particular information matching a current time instant and a current location of the vehicle and matching desired information preliminarily registered by said user, said method comprising:

making a digital broadcasting apparatus of a broadcasting station periodically broadcast a plurality of broadcast programs by using one of the digital satellite radio broadcasting and the digital surface wave radio broadcasting, each of said broadcast programs comprising a program content, a type information representative of a content type of said program content, time information representative of a time period during which said program content is valid, and location information representative of a location where said program content is valid;

making a favorite storage store a desired type of information;

making a route storage store pass point identifiers for a route, locations of said pass points, and a time interval between said pass points by;

making a current time instant storage hold a current time instant;

making a current location storage hold current location information;

receiving each of said broadcast programs;

comparing the type information of each of said broadcast programs with the desired type of the favorite storage and comparing the location information of each of said broadcast programs with the location of each of said pass points of said route storage to select a matched one of said broadcast programs that includes the type information coincident with the desired type of said favorite storage and the location information coincident with the location of each of said pass points of said route storage;

making a broadcast program storage store said matched one of the broadcast programs as a stored broadcast program;

comparing the current location information of said current location storage with the location of each pass point of said route storage, reading, when said vehicle passes a place sufficiently close to a particular one of the pass points of said route storage, the latest value of the current time instant from said current time instant storage as a read current time instant, and writing, as an actual pass time instant, said read current time instant into the actual pass time instant storage area of said route storage in correspondence to said particular one of the pass points of said route storage;

calculating, supplied with the current time instant from said current location storage and with the current location information from said current location storage, a scheduled pass time instant for a next scheduled pass point of the pass points of said route storage and the location of said next scheduled pass point;

comparing the time information and the location information of said stored broadcast program of said broadcast program storage with the scheduled pass time instant for said next scheduled pass point and the location of said next scheduled pass point to select said stored broadcast program as a selected broadcast program when said stored broadcast program includes the time information and the location information coincident with the scheduled pass time instant for said next scheduled pass point and the location of said next scheduled pass point; and reproducing said selected broadcast program.

11. The method of claim 10, wherein the time intervals stored in said route storage comprise time intervals between every adjacent ones of said pass points, wherein the current time instant comprises a latest value of a current time instant and the current location comprises a latest value of a current location.

12. The method of claim 10, wherein the comparison between the time information and the location information occurs periodically.

13. A recording medium recording a program for making a computer execute a route-adaptive on-demand radio communication method which is for a user of a vehicle and which is for providing, by using one of digital satellite radio broadcasting and digital surface wave radio broadcasting simultaneously broadcasted to unspecified recipients, said user with particular information matching a current time instant and a current location of the vehicle and matching desired information preliminarily registered by said user, said method comprising:

making a digital broadcasting apparatus of a broadcasting station periodically broadcast a plurality of broadcast programs by using one of the digital satellite radio broadcasting and the digital surface wave radio broadcasting, each of said broadcast programs comprising a program content, a type information representative of a content type of said program content, and time information representative of a time period during which said program content is valid, and location information representative of a location where said program content is valid;

making a favorite storage store a desired type of information;

making a route storage store pass point identifiers for a route, locations of said pass points, and a time interval between said pass points by said user;

making a current time instant storage hold current time instant;

making a current location storage hold current location information;

receiving each of said broadcast programs;

comparing the type information of each of said broadcast programs with the desired type of said favorite storage and comparing the location information of each of said broadcast programs with the location of each of said pass points of said route storage to select a matched one of said broadcast programs that includes the type information coincident with the desired type of said favorite storage and the location information coincident with the location of each of said pass points of said route storage;

making a broadcast program storage store said matched one of the broadcast programs as a stored broadcast program;

comparing the time information and the location information of said stored broadcast program of said broadcast program storage with the values of said current time instant storage and said current location storage, respectively, to select said stored broadcast program as a selected broadcast program when said stored broadcast program includes the time information and the location information coincident with the values held in said current time instant storage and said current location storage; and reproducing said selected broadcast program.

14. The medium of claim 13, wherein the time intervals stored in said route storage comprise time intervals between every adjacent ones of said pass points, wherein the current time instant comprises a latest value of a current time instant and the current location comprises a latest value of a current location.

15. The medium of claim 13, wherein the comparison between the time information and the location information occurs periodically.

16. A recording medium recording a program for making a computer execute a route-adaptive on-demand radio communication method which is for a user of a vehicle and which is for providing, by using one of digital satellite radio broadcasting and digital surface wave radio broadcasting simultaneously broadcasted to unspecified recipients, said user with particular information matching a current time instant and a current location of the vehicle and matching desired information preliminarily registered by said user, said method comprising:

making a digital broadcasting apparatus of a broadcasting station periodically broadcast a plurality of broadcast programs by using one of the digital satellite radio broadcasting and the digital surface wave radio broadcasting, each of said broadcast programs comprising a program content, a type information representative of a content type of said program content, and time information representative of a time period during which said program content is valid, and location information representative of a location where said program content is valid;

making a favorite storage store a desired type of information;

making a route storage store pass point identifiers for a route, locations of said pass points, and a time interval between said pass points;

making a current time instant storage hold a current time instant;

making a current location storage hold current location information;

receiving each of said broadcast programs;

comparing the type information of each of said broadcast programs with the desired type of the favorite storage and comparing the location information of each of said broadcast programs with the location of each of said pass points of said route storage to select a matched one of said broadcast programs that includes the type information coincident with the desired type of said favorite storage and the location information coincident with the location of each of said pass points of said route storage;

making a broadcast program storage store said matched one of the broadcast programs as a stored broadcast program;

comparing the value of the current location information of said current location storage with the location of each pass point of said route storage, reading, when said vehicle passes a place sufficiently close to a particular one of the pass points of said route storage, the value of the current time instant from said current time instant storage as a read current time instant, and writing, as an actual pass time instant, said read current time instant into said route storage in correspondence to said particular one of the pass point of said route storage, calculating, supplied with the value of the current time instant from said current location storage and with the value of the current location information from said current location storage, a scheduled pass time instant for a next scheduled pass point of the pass points of said route storage and the location of said next scheduled pass point;

comparing the time information and the location information of said stored broadcast program of said broadcast program storage the scheduled pass time instant for said next scheduled pass point and the location of said next scheduled pass point to select said stored broadcast program as a selected broadcast program when said stored broadcast program includes the time information and the location information coincident with the scheduled pass time instant for said next scheduled pass point and the location of said next scheduled pass point; and reproducing said selected broadcast program.

17. The medium of claim 16, wherein the time intervals stored in said route storage comprise time intervals between every adjacent ones of said pass points, wherein the current time instant comprises a latest value of a current time instant and the current location comprises a latest value of a current location.

18. The medium of claim 16, wherein the comparison between the time information and the location information occurs periodically.

19. A route-adaptive on-demand radio communication system comprising:

a favorite storage that stores information indicating a desired type;

a receiver that receives broadcast programs that include type information and location information;

a selector that selects a broadcast programs that include the desired type and the location of a pass point on a route; and a reproducer that reproduces the selected broadcast program.

* * * * *